US008100500B2

(12) United States Patent
Bansyo

(10) Patent No.: US 8,100,500 B2
(45) Date of Patent: Jan. 24, 2012

(54) INK JET PRINTER HAVING INK MAINTENANCE SYSTEM CONTROLLING MAINTENANCE IN ACCORDANCE WITH THE INK VISCOSITY BY USE OF A SIMPLE STRUCTURE

(75) Inventor: Toshihiro Bansyo, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 441 days.

(21) Appl. No.: 12/453,536

(22) Filed: May 14, 2009

(65) Prior Publication Data

US 2009/0284563 A1 Nov. 19, 2009

(30) Foreign Application Priority Data

May 15, 2008 (JP) ..... P2008-128616

(51) Int. Cl.

| | |
|---|---|
| ***B41J 29/393*** | (2006.01) |
| *B41J 29/38* | (2006.01) |
| *B41J 2/195* | (2006.01) |
| *B41J 2/165* | (2006.01) |
| *B41J 2/18* | (2006.01) |

(52) U.S. Cl. ..... 347/19; 347/6; 347/7; 347/9; 347/23; 347/89

(58) Field of Classification Search ..... 347/6, 7, 347/9, 19, 23, 89

See application file for complete search history.

(56) References Cited

U.S. PATENT DOCUMENTS

| | | | | |
|---|---|---|---|---|
| 2008/0136860 | A1* | 6/2008 | Kyoso | 347/19 |
| 2008/0158307 | A1* | 7/2008 | Nitta et al. | 347/85 |
| 2009/0174735 | A1* | 7/2009 | Yamada | 347/7 |
| 2009/0195588 | A1* | 8/2009 | Ogama | 347/17 |
| 2009/0322818 | A1* | 12/2009 | Iwasaki | 347/14 |

FOREIGN PATENT DOCUMENTS

| | | | |
|---|---|---|---|
| JP | 11-342634 | A | 12/1999 |
| JP | 2003-89226 | A | 3/2003 |
| JP | 2006-205744 | A | 8/2006 |

* cited by examiner

*Primary Examiner* — Laura Martin
*Assistant Examiner* — Jeremy Bishop
(74) *Attorney, Agent, or Firm* — The Nath Law Group; Jerald L. Meyer; Stanley N. Protigal

(57) ABSTRACT

An ink jet printer is provided with an ink circulation route which includes an ink jet head, an ink supply tank and an ink collection tank. A measuring unit obtains a value indicative of the flow resistance measured when ink flows from the ink supply tank to the ink collection tank through the ink jet head. A control unit is operable to select one of maintenance operations on the basis of the value indicative of measured flow resistance. When the flow resistance value is lower than a predetermined value, the control unit selects the operation of circulating ink around the ink circulation route as a maintenance operation, and the maintenance unit does not perform the maintenance operation which consumes some amount of ink. This configuration makes it possible to perform maintenance in accordance with the ink viscosity by use of a simple structure.

11 Claims, 15 Drawing Sheets

INK JET PRINTER HAVING INK MAINTENANCE SYSTEM CONTROLLING MAINTENANCE IN ACCORDANCE WITH THE INK VISCOSITY BY USE OF A SIMPLE STRUCTURE

BACKGROUND OF THE INVENTION

1. Field of the Invention

The present invention relates to a maintenance technique for ink jet printers having an ink circulation mechanism.

2. Description of the Background Art

In the case of an ink jet printer which prints images by ejecting ink from nozzles, when the print process has not been performed over a long time, the solvent of ink is evaporated or volatilized in the vicinity of ink jet heads so that the viscosity of ink is increased to degrade the print performance of the ink jet printer. Because of this, as the need arises, a maintenance operation is performed, for example, by suctioning the ink, cleaning nozzles and so forth.

Japanese Patent Published Application No. 2003-089226 describes a technique to perform maintenance by measuring the time elapsed after the previous maintenance and selecting an appropriate maintenance operation in accordance with the elapsed time. Also, Japanese Patent Published Application No. 2006-205744 describes a technique to perform maintenance by driving a head actuator, detecting entry of air bubbles, increase of the viscosity of ink and attaching of paper dust on the basis of the residual vibration, and selecting an appropriate maintenance operation in accordance with the results of the detection.

On the other hand, in recent years, it is proposed to provide an ink circulation route in the body of an ink jet printer to enable ink circulation for the purpose of improving the reliability of the print process as described in Japanese Patent Published Application No. Hei 11-342634. In the case of the ink jet printer having such an ink circulation mechanism, even if a nozzle clogs up with bubbles or debris, quick recovery is possible, and the ink circulation through the ink chamber of an ink jet head serves to sweep away high viscosity ink to the ink circulation route.

However, even if ink is circulated, when the ink jet printer is unused for a long time, the viscosity of ink is further increased so that maintenance such as suctioning ink becomes required in the same manner as in the conventional ink jet printers. It is preferred to perform the conventional maintenance only at a minimum frequency from the view point of saving ink because ink is consumed in vain by the process of suctioning ink and so forth during maintenance. Particularly, in the case of the ink jet printer having such an ink circulation mechanism, the thickened ink can be recovered by ink circulation as long as the viscosity of ink is not excessively increased, and thereby it is important to find out when it becomes necessary for ink to perform maintenance which consumes a certain amount of ink.

Because of this, an appropriate maintenance operation may be selected in accordance with the elapsed time after the previous maintenance as described in Japanese Patent Published Application No. 2003-089226. However, the elapsed time is not necessarily reflected in the viscosity of ink in a proportional manner, and thereby ink may unnecessarily be consumed, or necessary maintenance may not have been performed so that the viscosity of ink is increased to be too high to recover the thickened ink. Alternatively, it can be considered to perform maintenance by selecting an appropriate maintenance operation on the basis of the residual vibration as described in Japanese Patent Published Application No. 2006-205744. However, in this case, there is a problem that the production cost rises because of the circuit provided for detecting the residual vibration to increase the scale of the printer structure and the production cost.

SUMMARY OF THE INVENTION

Taking into consideration the above circumstances, it is an object of the present invention to make it possible for an ink jet printer with an ink circulation route to perform maintenance in accordance with the ink viscosity by a simple structure.

In order to accomplish the object as described above, the ink jet printer of the present invention is provided with an ink circulation route in which are arranged an ink jet head for ejecting ink, a first tank for supplying ink to the ink jet head, a second tank for collecting ink which is not consumed by the ink jet heads, and comprises: a maintenance unit operable to perform a maintenance operation which consumes some amount of ink; a measuring unit operable to obtain a value indicative of the flow resistance measured when ink flows the first tank to the second tank through the ink jet head; and a control unit operable to select one of maintenance operations on the basis of the value indicative of the flow resistance as obtained, wherein when the value indicative of the flow resistance as obtained is lower than a predetermined value, the control unit selects the operation of circulating ink around the ink circulation route as the one of maintenance operations, and the maintenance unit does not perform the maintenance operation which consumes some amount of ink.

The value indicative of the flow resistance measured when ink flows the first tank to the second tank through the ink jet head may be, for example, the time required for a predetermined amount of ink to flow from the first tank to the second tank, or the flow rate calculated by dividing the predetermined amount by the time. The value of these examples can be considered to indicate the ink viscosity in the ink jet head. Because of this, when the value indicative of the flow resistance is low, since the ink is evaluated as not so thickened that the maintenance operation which consumes some amount of ink is not needed, it is possible to avoid unnecessary consumption of ink. Generally speaking, since the value indicative of the flow resistance can be easily measured, it is possible to perform maintenance in accordance with the ink viscosity by a simple structure.

In a preferred embodiment, each of the first tank and the second tank is provided with an air release valve for releasing the inner pressure of each tank to air, the first tank is arranged in an upper position than the ink jet head, and the ink jet head is arranged in an upper position than the second tank.

By this configuration, the measuring unit obtains the value indicative of the flow resistance by opening the air release valves of the first and second tanks, and measuring the time required for a predetermined amount of ink to flow from the first tank to the second tank.

More specifically speaking, in this preferred embodiment, while the second tank is provided with upper and lower ink surface level sensors, the measuring unit obtains the value indicative of the flow resistance by opening the air release valves of the first and second tanks, and measuring the time elapses until the upper ink surface level sensor detects the ink surface level after the lower ink surface level sensor detects the ink surface level.

Preferably, the ink jet printer further comprises: a pressure adjusting unit operable to adjust the pressure of the first tank to a predetermined value in advance of measuring the required time, wherein the measuring unit measures the required time while the pressure of the first tank adjusted by the pressure adjusting unit is maintained to the predetermined value.

Also, in a preferred embodiment, the ink jet printer further comprises: a first pump operable to transport ink from the second tank to the first tank, wherein the first pump is driven when circulating ink around the ink circulation route as the maintenance operation. Preferably, the maintenance operation which consumes some amount of ink performed by the maintenance unit includes the operation of suctioning ink from an ink ejection surface of the ink jet head after circulating ink by driving the first pump. In this case, the maintenance unit may change, with reference to the value indicative of the flow resistance as obtained, the time for which ink is suctioned from the ink ejection surface of the ink jet head, or the force of suctioning ink. By this configuration, only a minimum amount of ink is consumed when suctioning ink.

Also, the measuring unit obtains the value indicative of the flow resistance again after performing the maintenance operation which consumes some amount of ink or the maintenance operation of circulating ink around the ink circulation route, and the control unit determines whether to perform the maintenance again on the basis of the value indicative of the flow resistance which is obtained again. Furthermore, preferably, the maintenance system is designed to cover the ink jet head and serves also as a cap for covering the ink ejection surface of the ink jet head.

In accordance with the present invention, it is possible to perform maintenance in accordance with the ink viscosity by a simple structure in an ink jet printer having an ink circulation route.

DESCRIPTION OF THE PREFERRED EMBODIMENTS

Figure 1:
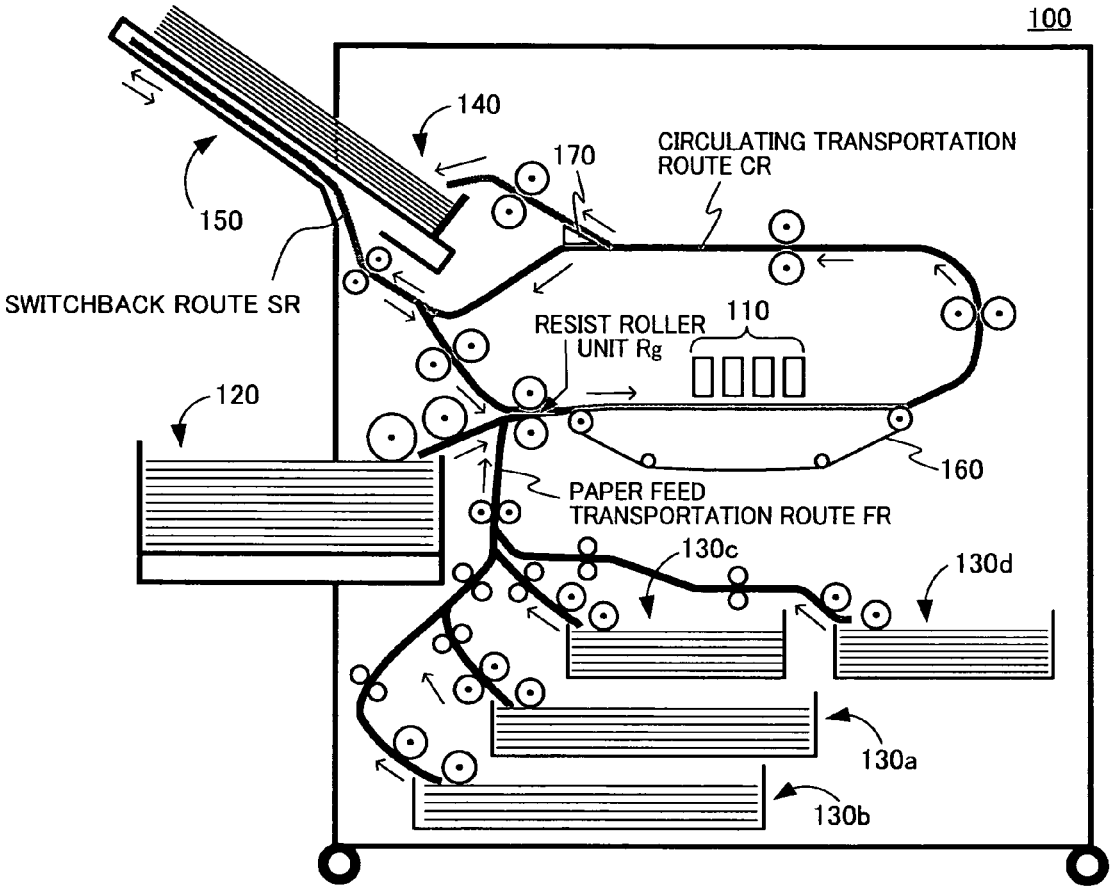
FIG. 1 is a schematic diagram for showing an ink jet printer having an ink circulation route in accordance with the present invention

In the following description, an embodiment of the present invention will be explained in conjunction with the accompanying drawings. FIG. 1 is a schematic diagram for showing an ink jet printer 100 in accordance with the present invention. Particularly, this figure shows print sheet circulation transportation routes. As shown in the same figure, the ink jet printer 100 is provided with a paper feed mechanism for feeding print sheets including a paper feed side tray 120 exposed from the side surface of the housing of the ink jet printer 100, a plurality of paper feed trays 130*a*, 130*b*, 130*c* and 130*d* which are located inside the housing. Furthermore, a discharge port 140 is provided as a discharge mechanism for discharging print sheets which have been printed.

The ink jet printer 100 is a line color ink jet printer. The line color ink jet printer is provided as a print mechanism with a plurality of ink jet heads each of which is provided with a number of nozzles formed to span the route in the direction perpendicular to the paper transportation direction. The respective ink jet heads eject black and color inks respectively in order to print images of the respective colors on a line-by-line basis. However, the present invention is not limited to a line ink jet printer, but also applicable to other types of printing apparatuses such as a serial color printer capable of forming images by scanning in the line direction.

The print sheets fed from either the paper feed side tray 120 or one of the paper feed trays 130 are transported one after another along a paper feed transportation route FR by a transportation mechanism such as roller units to a resist roller unit Rg. The resist roller unit Rg is composed of a pair of rollers and provided for defining a reference position at which the leading edge of each print sheet is aligned and oriented. The print sheet which is fed is stopped at the resist roller unit Rg for a short time, and then transferred in the direction toward the print mechanism with a predetermined timing.

A plurality of head units 110 including the ink jet heads are located on the transfer direction side of the resist roller unit Rg. The print sheet is printed to form an image with ink ejected from the ink jet heads provided in the respective head units 110 on a line-by-line basis, while being transported at a predetermined speed in accordance with printer option settings on a conveyor endless belt 160 which is located on the opposite side to the head units 110.

The print sheet which has been printed is further transported in the housing by the transportation mechanism such as roller units. In the case of one-side printing for printing only one side of the print sheet, the print sheet is transferred directly to the discharge port 140 and stacked on a catch tray 150 provided as a receiver at the discharge port 140 with the printed side down. The catch tray 150 is provided to protrude from the housing with a certain thickness. The catch tray 150 is slanted with a lower upright wall at which print sheets discharged from the discharge port 140 are automatically aligned under their own weight.

In the case of double-side printing for printing both sides of the print sheet, the print sheet is not transferred to the discharge port 140 just after printing the main side (the first printed side is called "main side", and the next printed side is called "back side" in this description), but is transported again in the housing. Because of this, the ink jet printer 100 is provided with a shunt mechanism 170 for switching the transfer route for printing on the back side. After printing on the main side, the shunt mechanism 170 transfers the print sheet which is not discharged to a switchback route SR such that the print sheet is reversed with respect to the transportation route by the switchback operation. The print sheet is transferred to the resist roller unit Rg again by the transportation mechanism such as roller units, and stopped at this resist roller unit Rg for a short time. Thereafter, the print sheet is transported to the print mechanism with a predetermined timing, and printed on the back side in the same manner as on the main side. After printing on the back side, the print sheet with images printed on the both sides is transferred to the discharge port 140, and stacked on the catch tray 150 serving as the receiver at the discharge port 140.

In the ink jet printer 100, the switchback operation is performed in the double-side printing mode by the use of the space formed in the lower portion of the catch tray 150. The space formed in the catch tray 150 is designed such that the print sheet cannot be accessed externally during the switchback operation. By this configuration, it is avoided that a user extracts the print sheet during the switchback operation by mistake. Incidentally, since the catch tray 150 is indispensable for the ink jet printer 100, there is no need for a separate space, which would be particularly provided in the ink jet printer 100 for the switchback operation, while making use of the space in the catch tray 150 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

Figure 2:
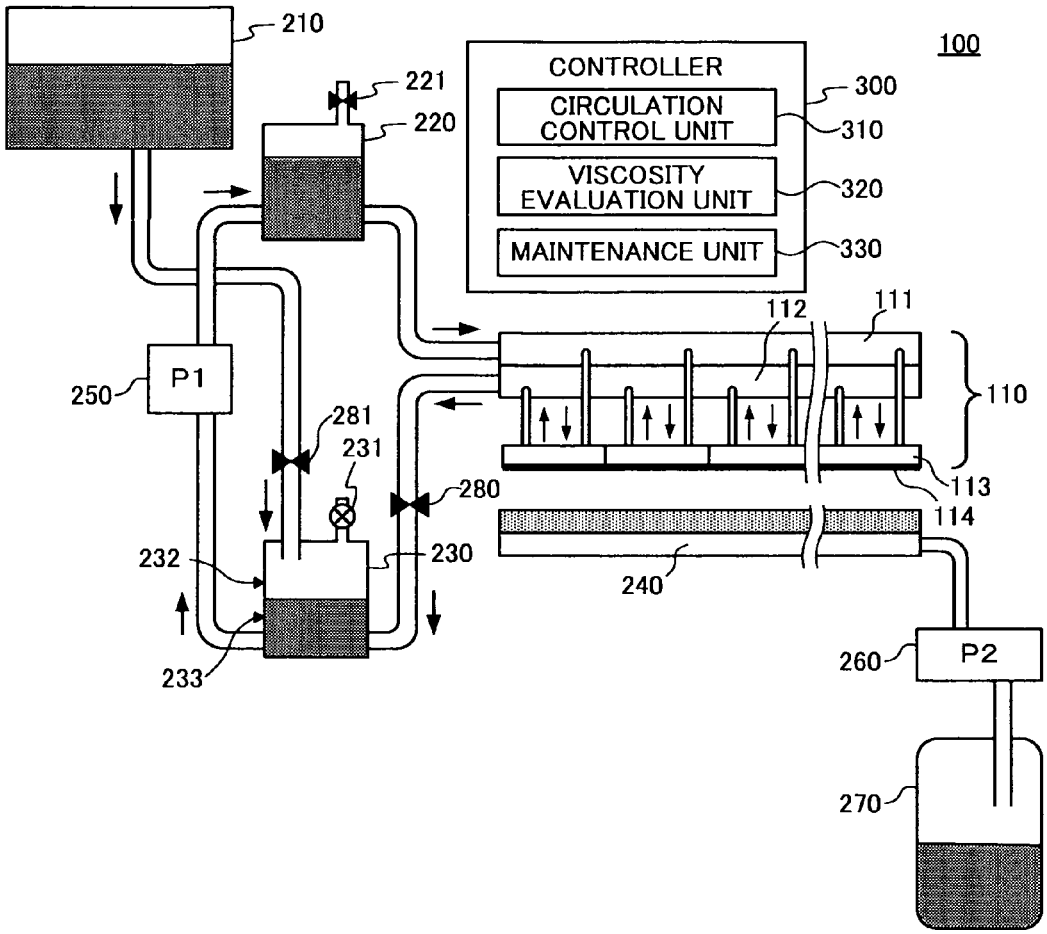
FIG. 2 is a block diagram for showing the configuration of the ink routes of the ink jet printer in accordance with the present invention.

FIG. 2 is a block diagram for showing the configuration of the ink routes of the ink jet printer 100. As shown in the same figure, the ink jet printer 100 is a printing apparatus which employs an ink circulation system for circulating ink which is supplied from a detachable ink tank 210. The ink jet printer 100 is provided with an ink jet head 113 having a nozzle plate 114 on which are arranged a number of nozzles which eject droplets of ink for printing. The ink jet head 113 is included in the head unit 110. Incidentally, needless to say, while only one color ink is illustrated in this figure, a plurality of color inks are used for printing color images, and necessary ink routes are provided for each color ink in the ink jet printer 100.

The ink jet head 113 is divided into a plurality of blocks. The head unit 110 is provided with a distributor 111 for supplying ink to each block of the ink jet head 113, and an ink collecting unit 112 for collecting ink which is not used for printing from each block of the ink jet head 113.

The ink which is supplied from the ink tank 210 is temporarily stored in a lower tank 230 which is provided in the downstream side of the ink jet head 113. Also, the ink stored in the lower tank 230 is transferred by a first pump 250 to an upper tank 220 which is provided in the upstream side of the ink jet head 113, and supplied to the ink jet head 113 from the upper tank 220. The ink which is not used in the ink jet head 113 for printing is returned to the lower tank 230 again. The amount of ink which is consumed by the print process is compensated by supplying ink from the ink tank 210 to the downstream tank 230 through an on-off valve 281.

The ink jet head 113 is located in an upper position than the downstream tank 230, and the upper tank 220 is located in an upper position than the ink jet head 113. The water head differences on the basis of this positional relationship are used to supply ink from the upstream tank 220 to the ink jet head 113, and return the ink remaining after the print process from the ink jet head 113 to the downstream tank 230.

The upstream tank 220 and the downstream tank 230 are provided with an air release valve 221 and an air release valve 231 respectively for switching the inside state of each tank between an air-tight state and an open-air state. Also, the downstream tank 230 is provided with a first fluid level sensor 232 and a second fluid level sensor 233 for detecting the ink surface level in the downstream tank 230. The first fluid level sensor 232 is located in a higher position than the second fluid level sensor 233.

There is an on-off valve 280 between the ink jet head 113 and the downstream tank 230. Incidentally, although not shown in the figure, it is preferred to provide a filter for removing bubbles and debris from the circulating ink, for example, between the first pump 250 and the upstream tank 220. Bubbles and debris can be eliminated from the ink transported from the upstream tank 220 to the ink jet head 113 by the filter, and thereby it is possible to prevent ink ejection failure due to nozzle blockage or the like.

Figure 3:
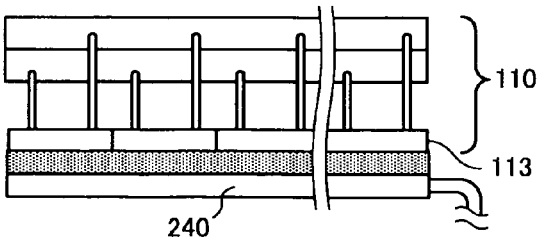
FIG. 3 is a schematic diagram for showing a maintenance system and an ink jet head joined to each other in accordance with the present invention.

Furthermore, the ink jet printer 100 is provided with a maintenance system 240 for performing maintenance of the ink jet head 113. The maintenance system 240 is designed to cover the whole of the nozzle plate 114 of the ink jet head 113. For example, when the print process is not performed, the maintenance system 240 is joined to the ink jet head 113 and serves as a cap for preventing ink from being degraded due to evaporation, volatilization and oxidation of the ink components as illustrated in FIG. 3. In the joined state as illustrated in FIG. 3, the maintenance system 240 provides a wiper function for removing ink from the nozzle plate 114 by the use of a rubber blade or a roller, and an ink suctioning function for suctioning ink from the nozzle plate 114 by driving the second pump 260. The suctioned ink is stored in a waste tank 270.

In addition, the ink jet printer 100 is provided with a controller 300. The controller 300 is a functional unit of the ink jet printer 100 serving to perform the print process, maintenance operation and so forth. The hardware of the controller 300 includes a CPU, a memory and the like. In the case of the present embodiment, the controller 300 is provided with a circulation control unit 310 for controlling the circulation of ink, a viscosity evaluation unit 320 for evaluating the viscosity of ink in the vicinity of the ink jet head 113, and a maintenance unit 330 for controlling the maintenance operation. These units perform the processes to be described below by controlling the opening and closing operations of the air release valves 221 and 231 of the upstream and downstream tanks, controlling the operations of the first and second pumps 250 and 260, and controlling the operation of the maintenance system 240.

Figure 4:
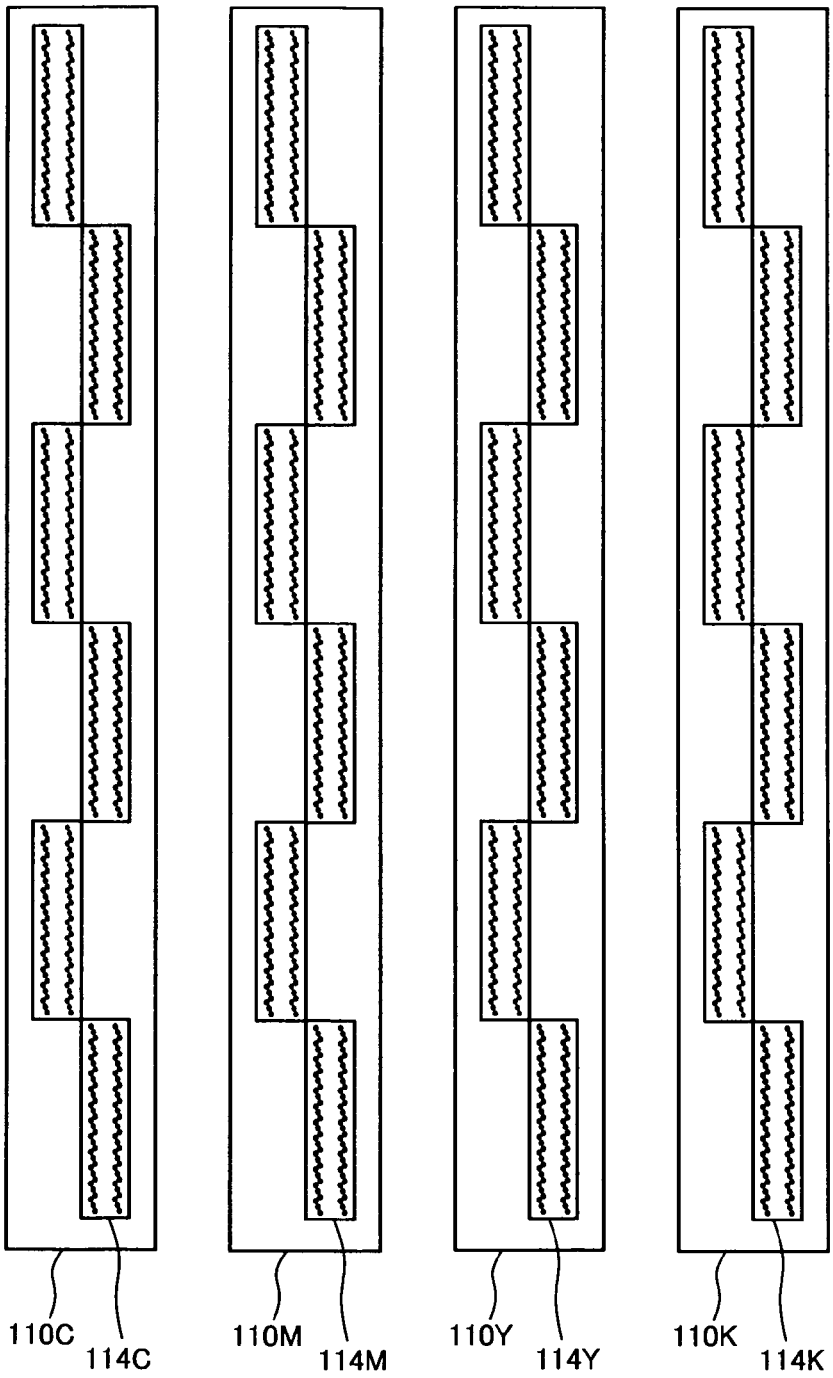
FIG. 4 is a schematic diagram for showing the surface of a nozzle plate of the ink jet printer in accordance with the present invention.

FIG. 4 is a schematic diagram for showing the nozzle arrangement side of the nozzle plate 114 with the ink jet head 113 as seen from the ink ejection side. As shown in the same figure, the ink jet printer 100 is provided with a head unit 110K for printing black ink, a head unit 110Y for printing yellow ink, a head unit 110M for printing magenta magenta, and a head unit 110C for printing cyan ink. These head units are provided with the nozzle plates 114K, 114Y, 114M and 114C which are collectively referred to as the nozzle plate 114 and each of which is divided into six blocks. Each nozzle plate 114 is provided with a number of nozzles which eject droplets of ink for printing.

Figure 5:
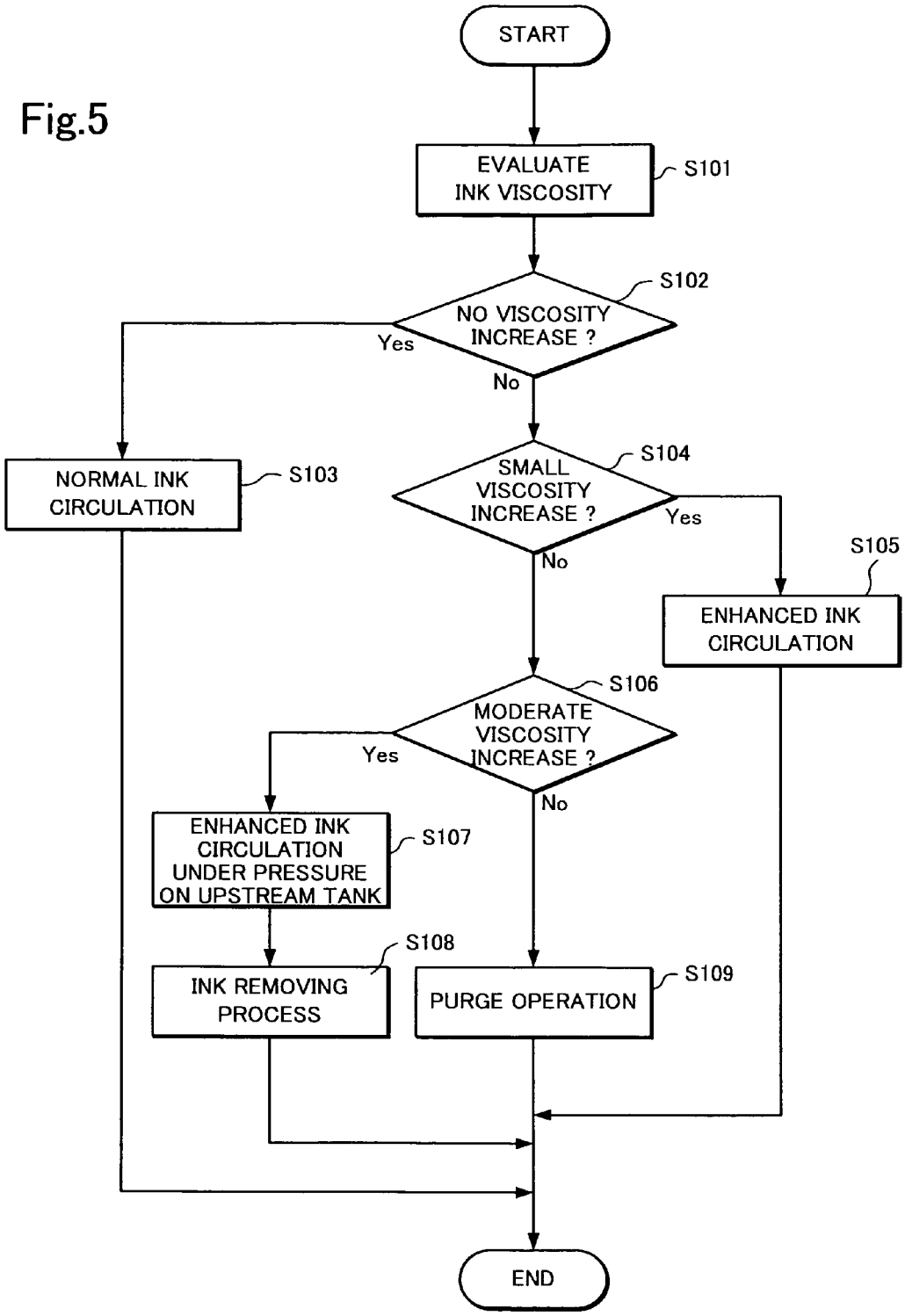
FIG. 5 is a flow chart for showing the flow of the maintenance operation in accordance with the present invention.

Next is a description of the maintenance operation in accordance with the present embodiment. FIG. 5 is a flow chart for showing the flow of the maintenance operation. This maintenance operation is automatically performed, for example, when a predetermined time elapses after performing the previous maintenance operation, when a predetermined number of sheets have been printed after performing the previous maintenance operation, or when starting up the printer. Alternatively, the maintenance operation may be performed in response to user's instruction. Furthermore, the maintenance operation may be performed in response to changes in the ambient environment, for example, the changes in the ambient temperature, the degree of humidity, the installation location and so forth which are detected by sensors provided in the ink jet printer 100.

In the maintenance operation, first, the ink viscosity is evaluated in step S101. The evaluation of ink viscosity will be explained in accordance with the present embodiment. In the case of the present embodiment, the ink viscosity is monitored, and the maintenance is performed in accordance with the monitored ink viscosity. By this configuration, the amount of ink consumed by maintenance is reduced, and unnecessary maintenance is not performed to save a certain time. For this purpose, the ink viscosity is evaluated in advance of actually performing the maintenance operation.

The increase in the ink viscosity occurs mainly in the vicinity of the ink jet head 113. Because of this, when the ink viscosity is increased, ink flow is disrupted in the ink jet head 113. In the case of the present embodiment, the ink viscosity is evaluated by evaluating how smoothly ink can flow, i.e., the flow resistance in the ink flow in the vicinity of the ink jet head 113, rather than directly measuring the ink viscosity. The ink viscosity is therefore evaluated by flowing ink through the ink jet head 113 and measuring the time until a predetermined amount of ink has flowed. The ink viscosity can therefore be evaluated to be higher as the measured time is longer. By this configuration, the ink viscosity can be evaluated only by a simple structure without need for an expensive viscosity measurement circuit, an expensive flow sensor or the like.

Figure 6:
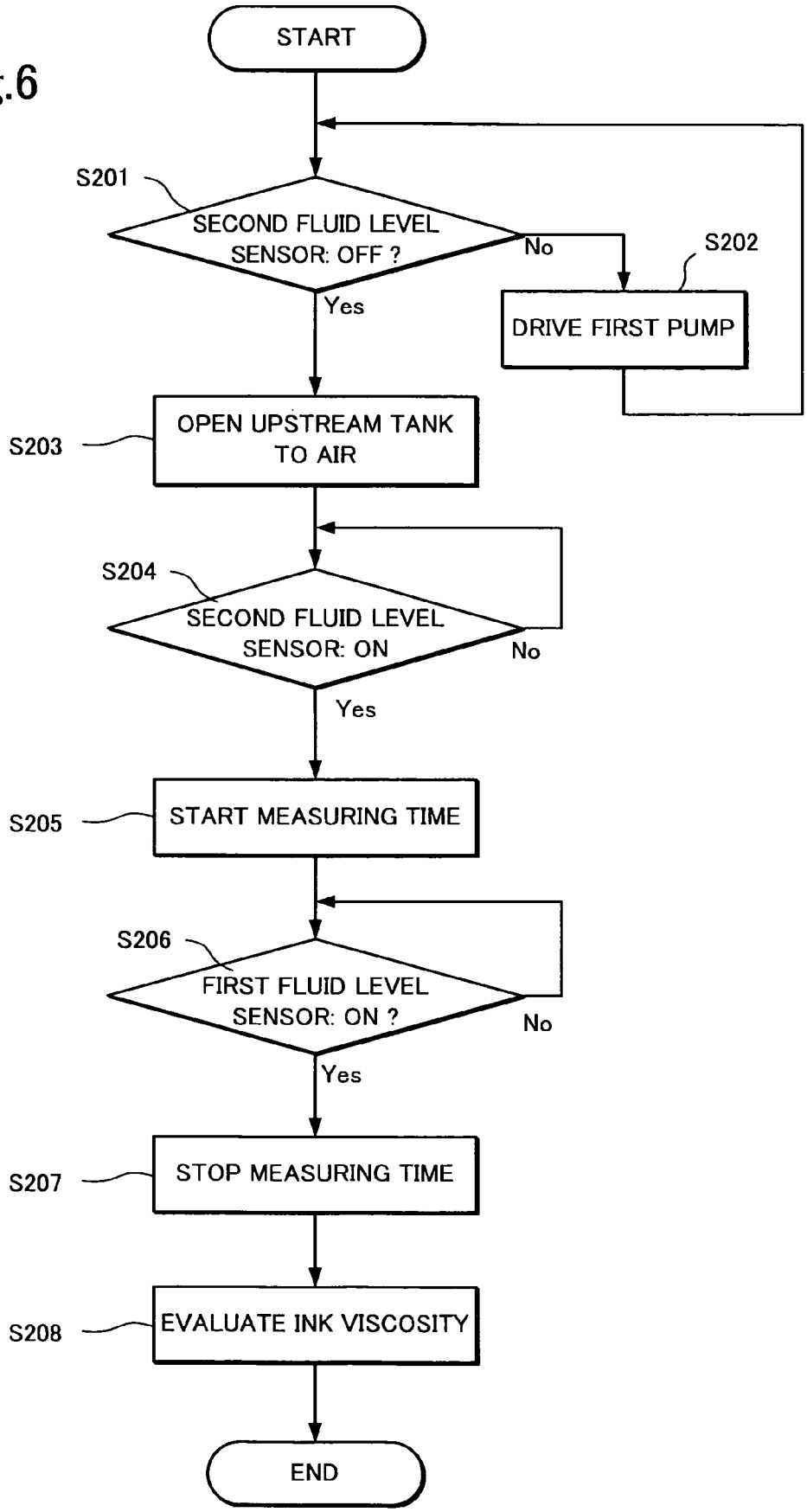
FIG. 6 is a flow chart for showing the flow of the process of evaluating the ink viscosity in accordance with the present invention.
Figure 7A:
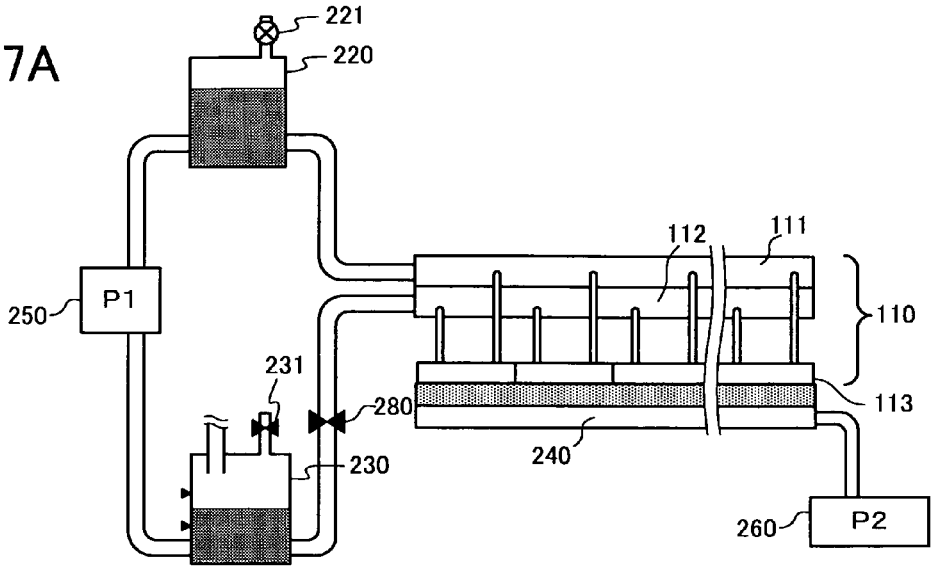
FIG. 7A is a schematic diagram for showing the ink routes in which an upstream tank is tightly closed, and a downstream tank is opened to air in accordance with the present invention.

FIG. 6 is a flow chart for showing the flow of the process of evaluating the ink viscosity. Incidentally, the ink circulation is halted in a stand-by state. Because of this, in the stand-by state as shown in FIG. 7A, the first pump 250 is stopped, the upstream tank 220 is tightly closed by closing the on-off valves 221, and the downstream tank 230 is opened to air by opening the on-off valve 231. In this state, since the upstream tank 220 is tightly closed, the ink jet head 113 is not supplied with ink. Also, since the downstream tank 230 is opened to air, the nozzles of the ink jet head 113 are stabilized by a negative pressure which is applied by the water head difference between the downstream tank 230 and the nozzle plate 114 of the ink jet head 113.

As a preprocess for starting the process of evaluating the ink viscosity, it is determined whether or not the second fluid level sensor 233 is turned off, i.e., whether or not the ink surface level of the downstream tank 230 is no higher than the second fluid level sensor 233 (step S201 in FIG. 2). This is because the process of evaluating the ink viscosity is performed by flowing ink through the ink jet head 113 and measuring the time required for the ink surface level to rise the position of the second fluid level sensor 233 to the position of the first fluid level sensor 232. Accordingly, if the ink surface level of the downstream tank 230 is higher than the second fluid level sensor 233, i.e., the second fluid level sensor 233 is turned on (step S201: No), the first pump 250 is driven in step S202 to transport ink from the downstream tank 230 to the upstream tank 220 until the second fluid level sensor 233 is turned off.

Figure 7B:
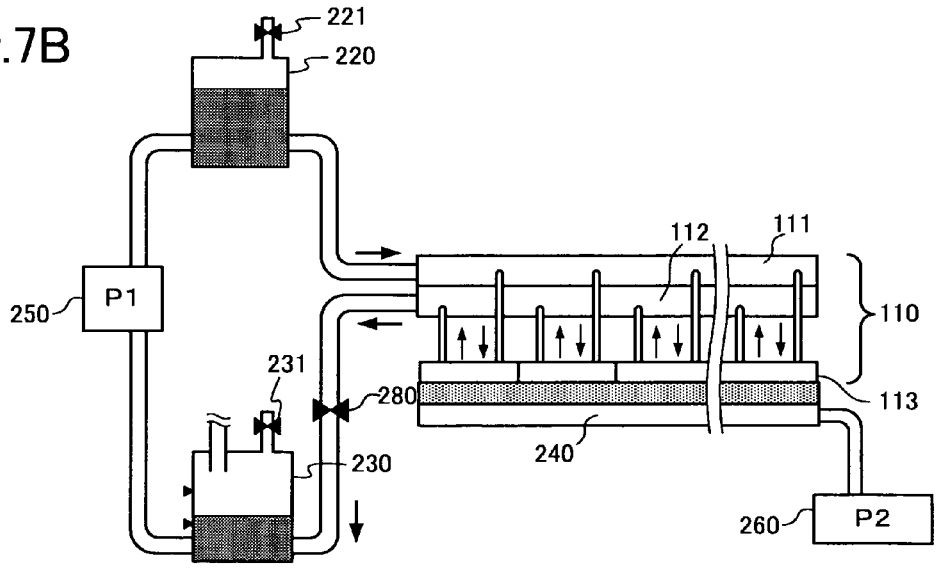
FIG. 7B is a schematic diagram for showing the ink routes in which the upstream tank is opened to air in accordance with the present invention.

Conversely, if the second fluid level sensor 233 is turned off (step S201: Yes), as illustrated in FIG. 7B, the air release valve 221 of the upstream tank 220 is opened to open the upstream tank 220 to air in step S203. The ink jet head 113 is then given a positive pressure which is applied by the water head difference between the upstream tank 220 and the ink jet head 113, and a negative pressure which is applied by the water head difference between the downstream tank 230 and the ink jet head 113. Because of this, the ink stored in the upstream tank 220 flows through the ink jet head 113 into the downstream tank 230. Meanwhile, the upstream tank 220 and the downstream tank 230 are arranged in order that the water head difference therebetween shall not cause an excessive pressure larger than the withstand pressure of the ink jet head 113.

Figure 7C:
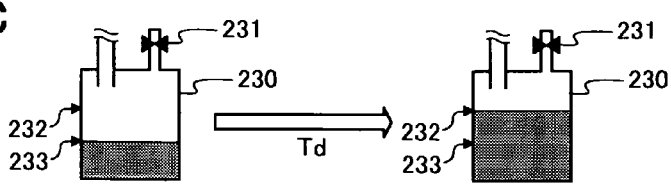
FIG. 7C is a view for explaining the process of measuring the elapsed time for evaluating the ink viscosity in accordance with the present invention.

When the ink surface level rises in the downstream tank 230 to turn on the second fluid level sensor 233 (step S204: Yes), measurement of time is started in step S205. The measurement of time is continued until the first fluid level sensor 232 is turned on (step S206: Yes), and then stopped in step S207. Namely, as illustrated in FIG. 7C, the time Td required for the ink surface level to rise from the position of the second fluid level sensor 233 to the position of the first fluid level sensor 232 is measured. Since this measured time Td becomes longer as the ink viscosity is higher in the ink jet head 113, it is possible to evaluate the ink viscosity on the basis of this measured time Td in step S208. The criteria for evaluating the ink viscosity (the relationship between the ink viscosity and the measured time Td) has been determined in advance by experiments or the like, and stored in the viscosity evaluation unit 320 of the controller 300.

It is assumed here that the first fluid level sensor 232 is turned on z1 (seconds) after the second fluid level sensor 233 is turned on when the ink viscosity is normal, under the differential pressure x1 (pascals) between the upstream tank 220 and the differential ink amount y1 (milliliters) between the ink amounts when the second fluid level sensor 233 is turned on and when the first fluid level sensor 232 is turned on. However, when the ink viscosity becomes high in the ink jet head 113, in the same conditions, it takes z2 (seconds) which is longer than z1 (seconds) for the first fluid level sensor 232 to be turned on after the second fluid level sensor 233 is turned on. This is because the pressure loss is increased by the increased flow resistance so that the ink amount flowing per unit time is decreased even under the same differential pressure.

In this case, the flowing ink amount U, the differential pressure P and the flow resistance R satisfy the relation that $U \propto P/R$. However, in the case of the present embodiment, the variation degree the flow resistance can be evaluated simply by measuring the elapsed time Td rather than measuring and calculating the actual flow resistance. In what degree the flow resistance varies in relation to the flow resistance in the normal ink condition is referred to herein as "the variation degree of the flow resistance". Alternatively, the variation degree of the flow resistance can be evaluated on the basis of the flow volume per unit time which is calculated by dividing, by the time Td, the differential ink amount between the ink amounts when the second fluid level sensor 233 is turned on and when the first fluid level sensor 232 is turned on, rather than evaluated on the basis of the elapsed time Td itself.

In order to more accurately evaluate the variation degree of the flow resistance, it is preferred to measure the time Td after setting the ink surface level of the upstream tank 220 to a predetermined position and setting the differential pressure between the upstream tank 220 and the downstream tank 230 to a predetermined value for each measurement. Because of this, in this preferred implementation, a fluid level sensor is provided also for the upstream tank 220 in order to set up the ink surface level of the upstream tank 220 to the predetermined position in advance of each measurement.

In the case of the present embodiment, it is assumed that the condition of the ink viscosity is evaluated as one of "no viscosity increase", "small viscosity increase", "moderate viscosity increase" and "large viscosity increase" on the basis of the measured time Td. Namely, when the measured time Td is substantially equal to the reference time which is measured when the ink viscosity is normal, the condition of the ink viscosity is evaluated as "no viscosity increase". When the measured time Td is longer than the reference time by a small excess, a moderate excess or a large excess, the condition of the ink viscosity is evaluated as "small viscosity increase, "moderate viscosity increase" or "large viscosity increase" respectively. Of course, this is only one of examples, and other classification may be employed instead.

In the case of the present embodiment, the maintenance operation is changed in accordance with the condition of the ink viscosity which is evaluated as described above. Referring to the flow chart of FIG. 5 again, a specific method of performing maintenance will be explained. However, the following method is only illustrative, but the present invention is not limited thereto.

Figure 8:
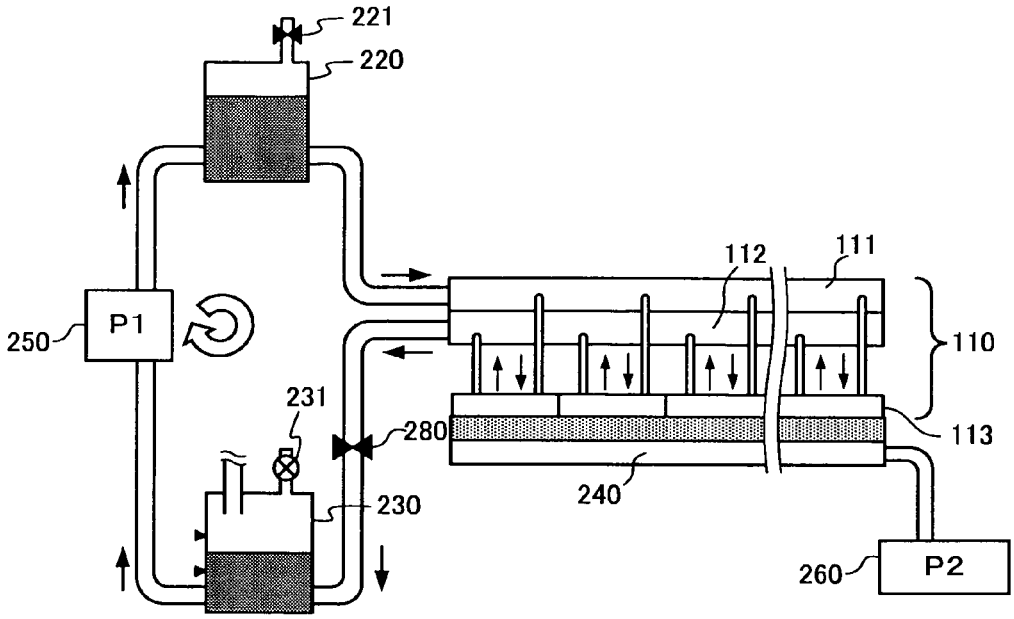
FIG. 8 is a view for explaining a normal ink circulation in accordance with the present invention.

When the ink viscosity is evaluated as "no viscosity increase" (step S102: Yes), the ink circulation is performed in a usual manner. The ink inside the ink jet head 113 can be replaced by this circulation without consuming the ink. FIG. 8 is a view for explaining the normal ink circulation. As shown in the same figure, when the normal ink circulation is performed, after opening the air release valve 221 to open the upstream tank 220 to air and closing the air release valve 231 to tightly close the downstream tank 230, the first pump 250 is driven to transport ink from the downstream tank 230 to the upstream tank 220. Then, negative pressure of the nozzle plate 114 is maintained by the positive pressure applied by the water head difference between the ink surface level of the upstream tank 220 and the nozzle plate 114 of the ink jet head 113, and the negative pressure of the downstream tank 230 caused by driving the first pump 250, and thereby the ink is circulated around the ink circulation route. Incidentally, in this process, the maintenance system 240 may not be joined to the ink jet head 113.

Figure 9A:
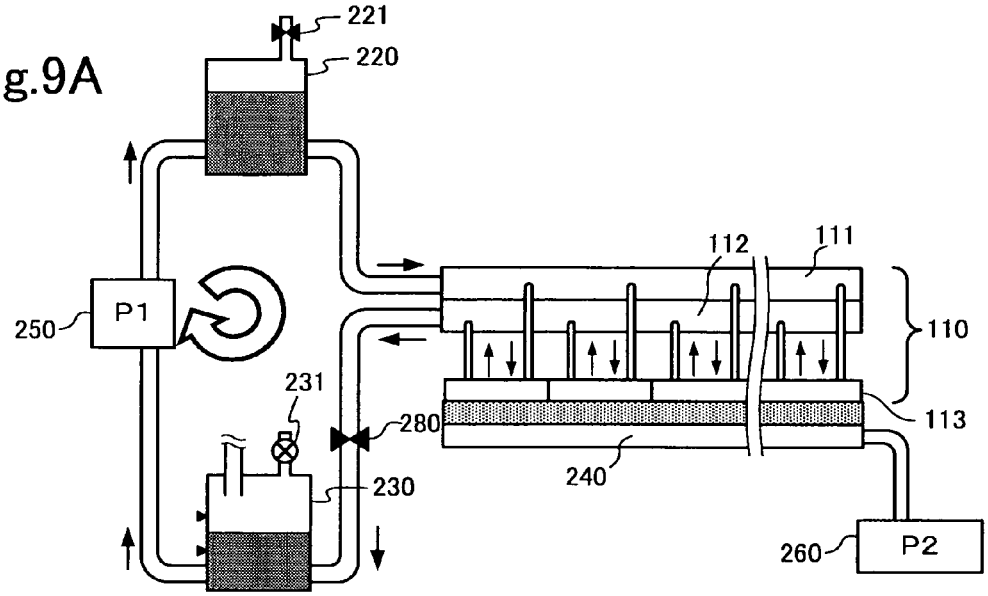
FIG. 9A is a view for explaining an example of the enhanced ink circulation in accordance with the present invention.

When the ink viscosity is evaluated as "small viscosity increase" (step S104: Yes), a more enhanced ink circulation than usual is performed in step S105 by increasing the differential pressure between the upstream tank 220 and the downstream tank 230. FIG. 9A is a view for explaining the enhanced ink circulation. As shown in the same figure, when the enhanced ink circulation is performed, after opening the air release valve 221 to open the upstream tank 220 to air and closing the air release valve 231 to tightly close the downstream tank 230, the first pump 250 is driven by higher power than for the normal ink circulation to transport a large amount of ink from the downstream tank 230 to the upstream tank 220. Then, while the ink surface level of the upstream tank 220 rises to increase the positive pressure applied by the water head difference between the ink surface level of the upstream tank 220 and the nozzle plate 114 of the ink jet head 113, the negative pressure applied to the nozzle plate 114 is maintained by strongly driving the first pump 250 to apply an increased negative pressure to the downstream tank 230, and thereby the ink is circulated around the ink circulation-route in a more accelerated manner than during the normal ink circulation. By this configuration, the ink which is lightly thickened inside the ink jet head 113 can be pushed out and replaced by normal ink without unnecessary ink consumption. Meanwhile, also in this process, the maintenance system 240 may not be joined to the ink jet head 113. Also, the condition of ink corresponding to "small viscosity increase" may be classified into a plurality of viscosity levels, and the period of circulating ink and/or the driving power of the first pump 250 may be adjusted in accordance with the viscosity level.

Figure 9B:
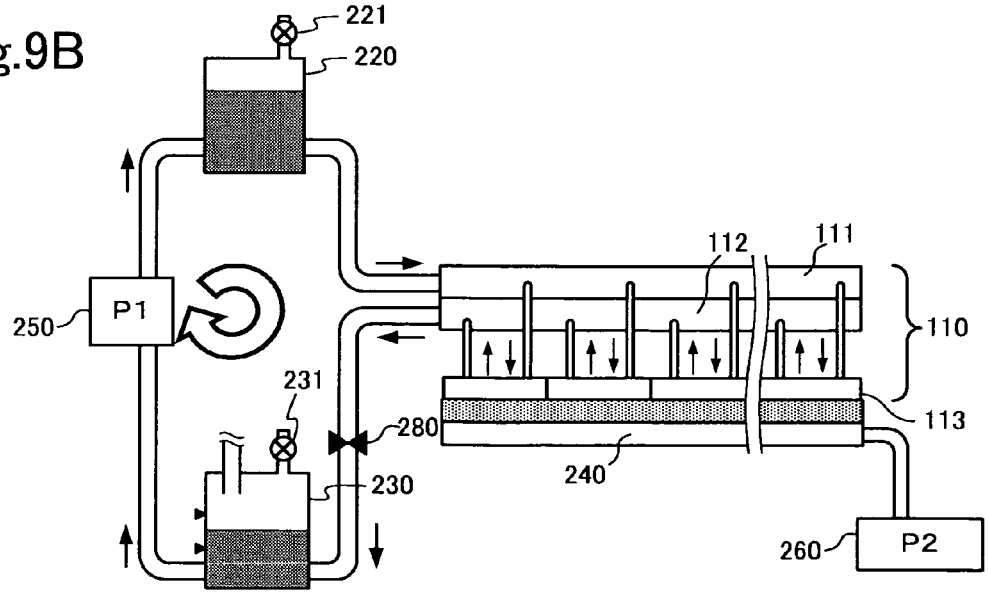
FIG. 9B is a view for explaining another example of the enhanced ink circulation in accordance with the present invention.

In this regards, as illustrated in FIG. 9B, when the enhanced ink circulation is performed, both the air release valve 221 and the air release valve 231 may be closed to tightly close the upstream tank 220 and the downstream tank 230 in advance of driving the first pump 250 by higher power than for the normal ink circulation to transport a large amount of ink from the downstream tank 230 to the upstream tank 220. The negative pressure applied to the nozzle plate 114 is maintained by driving the first pump 250 to apply a positive pressure to the upstream tank 220 and a negative pressure to the downstream tank 230.

Figure 10:
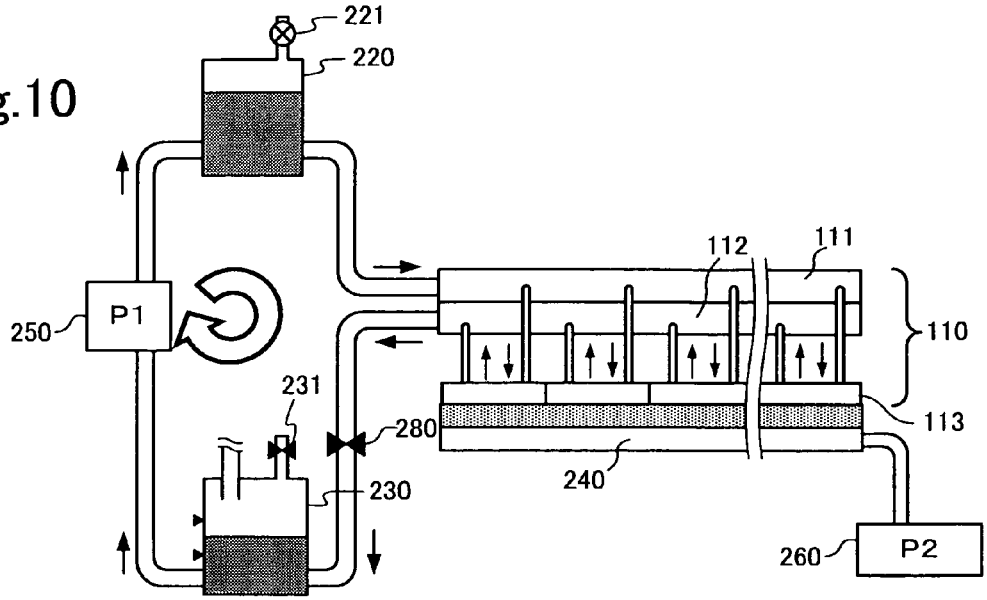
FIG. 10 is a view for explaining this enhanced ink circulation under the increased pressure applied to the upstream tank in accordance with the present invention.

When the ink viscosity is evaluated as "moderate viscosity increase" (step S106: Yes), the ink circulation is performed in a more enhanced manner in step S107 by increasing the differential pressure between the upstream tank 220 and the downstream tank 230. For this purpose, during the ink circulation is performed, a positive pressure is applied to the nozzle plate 114 by increasing the pressure in the upstream tank 220. FIG. 10 is a view for explaining this enhanced ink circulation under the increased pressure applied to the upstream tank 220. As shown in the same figure, when the enhanced ink circulation is performed under the increased pressure applied to the upstream tank 220, after closing the air release valve 221 to tightly close the upstream tank 220 and opening the air release valve 231 to open the downstream tank 230 to air, the first pump 250 is driven by higher power than for the normal ink circulation to transport a large amount of ink from the downstream tank 230 to the upstream tank 220. Then, the ink which is moderately thickened in the nozzle plate 114 can be removed from the ink jet head 113 by pushing out the moderately thickened ink from the nozzle plate 114 under the increased pressure applied to the upstream tank 220 and flowing the ink inside the ink route into the downstream tank 230 by the ink circulation.

Figure 11:
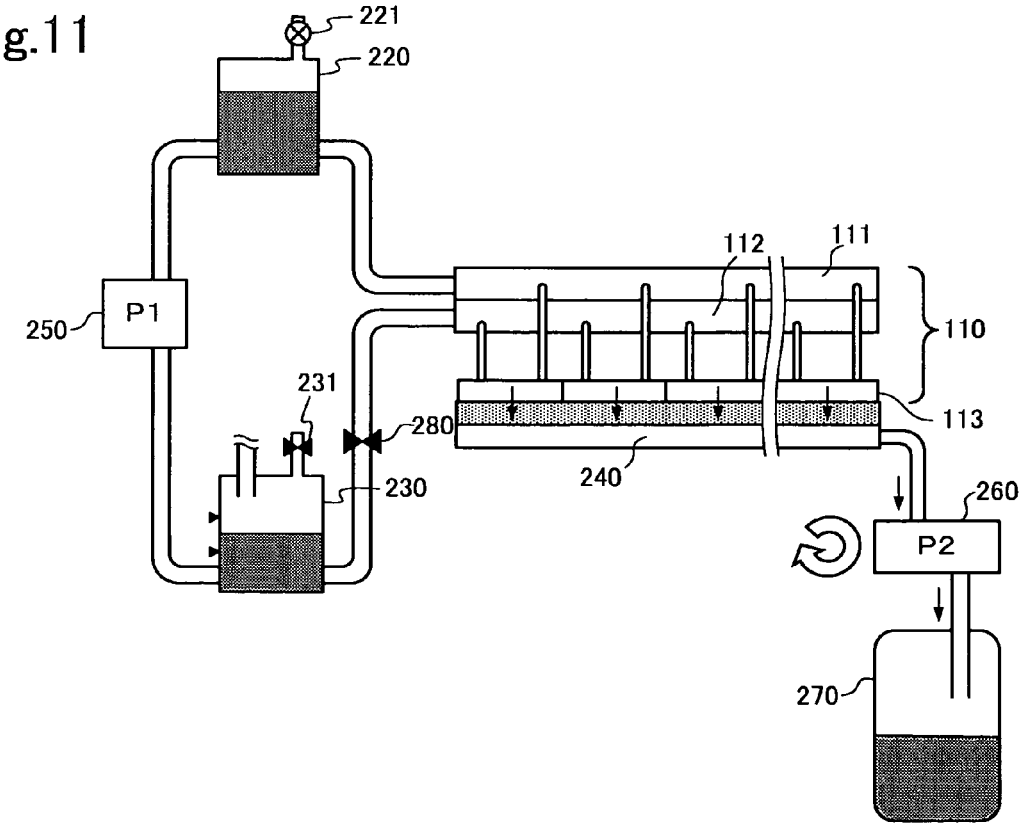
FIG. 11 is a view for explaining the suctioning operation in accordance with the present invention.

When this process is performed, the maintenance system 240 is operated to remove the ink pushed out from the nozzle plate 114 by the wiper operation (removing ink from the nozzle plate 114 by the use of a rubber blade or a roller) and/or the ink suctioning operation (removing ink from the nozzle plate 114 by suctioning ink) in step S108. FIG. 11 is a view for explaining the suctioning operation. As shown in the same figure, the maintenance system 240 is joined to the ink jet head 113, and then the second pump 260 is driven to suction ink as the suctioning operation. The suctioned ink is stored in the waste tank 270.

Also, the condition of ink corresponding to "moderate viscosity increase" may be classified into a plurality of viscosity levels, and the period of circulating ink, the driving power of the first pump 250, the period of suctioning ink, the driving power of the second pump 260 and/or the like factor may be adjusted in accordance with the viscosity level.

Figure 12:
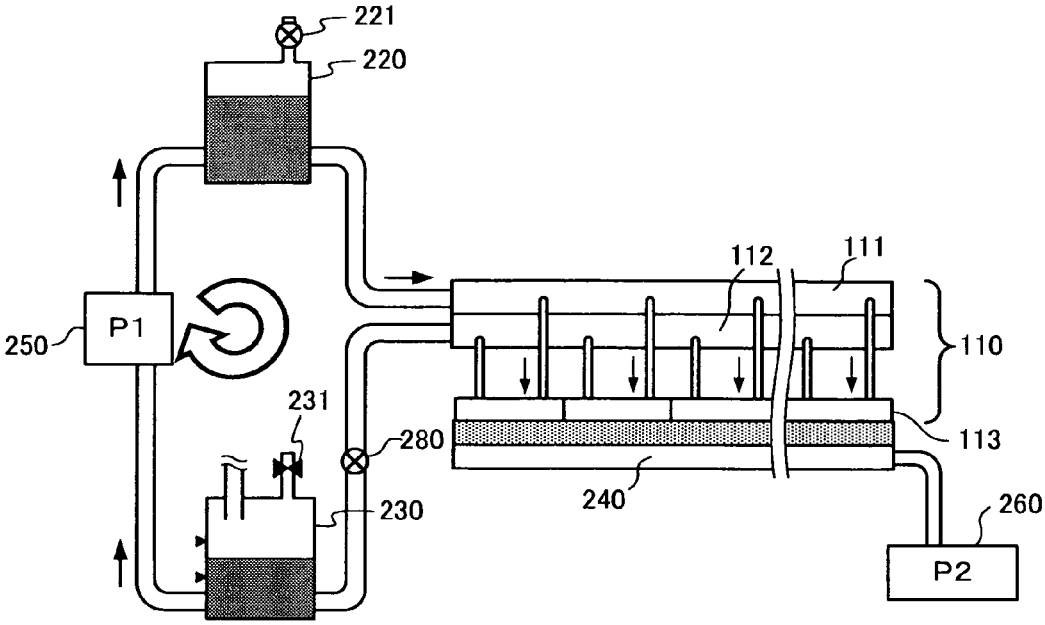
FIG. 12 is a view for explaining the purge operation under the increased pressure in accordance with the present invention.

When the ink viscosity is evaluated as "large viscosity increase" (step S106: No), a purge operation is performed in step S109 to forcibly push out ink from the nozzle plate 114 by applying an increased pressure to the route. Also, the condition of ink corresponding to "large viscosity increase" may be classified into a plurality of viscosity levels, and the purge operation is adjusted in accordance with the viscosity level by changing the pressure applied to the route and/or changing the period of applying the pressure. FIG. 12 is a view for explaining the purge operation under the increased pressure. As shown in the same figure, when the purge operation is performed under the increased pressure, after closing the air release valve 221 to tightly close the upstream tank 220 and closing the on-off valve 280 to close the path from the ink jet head 113 to the downstream tank 230, the first pump 250 is driven by higher power than for the normal ink circulation to apply a pressure to the nozzle plate 114. During the purge operation, the maintenance system 240 is joined to the ink jet head 113.

Figure 13A:
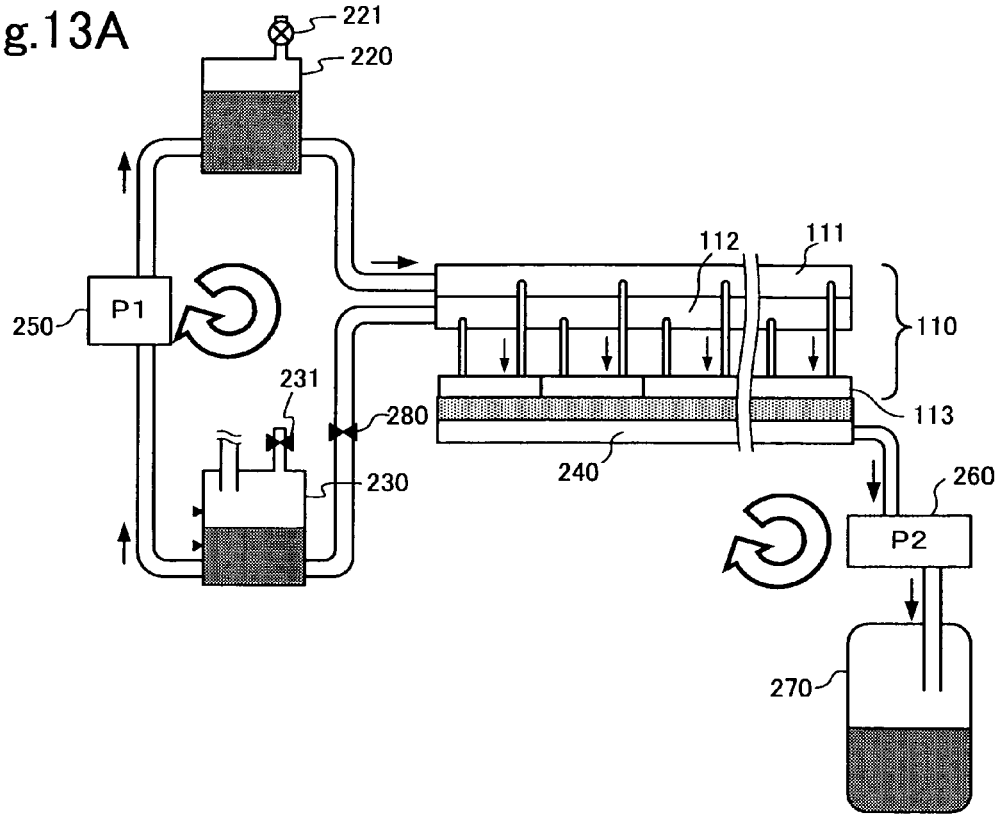
FIG. 13A is a view for explaining a first alternative example of the purge operation in accordance with the present invention.

FIG. 13A is a view for explaining a first alternative example of the purge operation. As shown in the same figure, after closing the air release valve 221 to tightly close the upstream tank 220 and opening the air release valve 231 to open the downstream tank 230 to air, the ink suctioning operation is performed by strongly driving the first pump 250 by higher power than for the normal ink circulation to increase the pressure on the ink supplying side and strongly driving the second pump 260 with the maintenance system 240 which is joined to the ink jet head 113 to decrease the pressure on the ink collecting side.

Figure 13B:
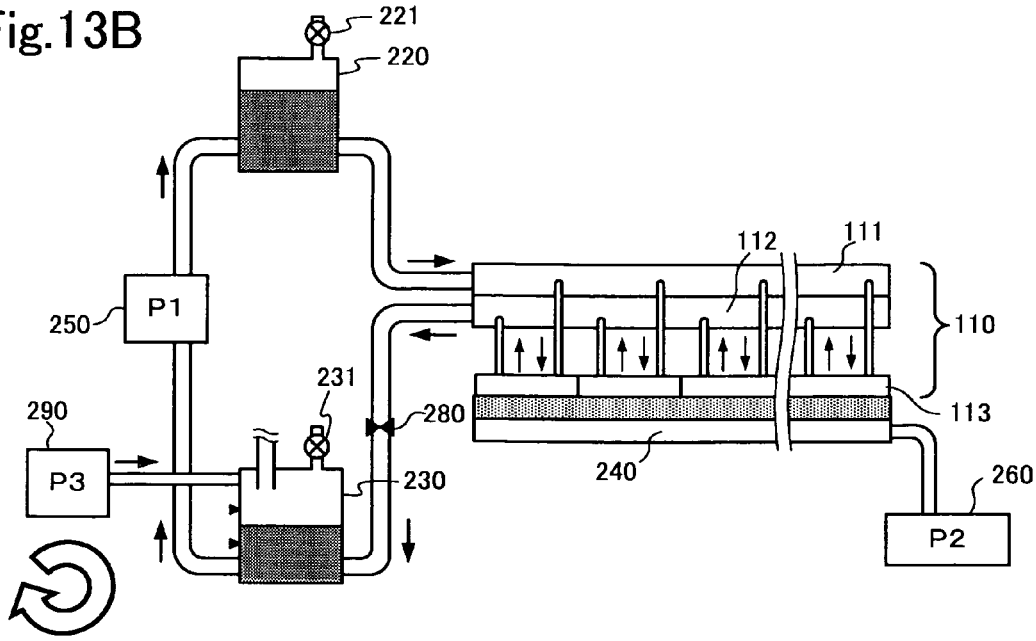
FIG. 13B is a view for explaining a second alternative example of the purge operation in accordance with the present invention.

FIG. 13B is a view for explaining a second alternative example of the purge operation. In this example, a third pump 290 is provided anew for applying a pressure to the downstream tank 230. As shown in FIG. 13B, after closing both the air release valve 221 and the air release valve 231 to tightly close both the upstream tank 220 and the downstream tank 230, the purge operation is performed to apply a pressure to the route by strongly driving the third pump 290.

Generally speaking, the purge operation is performed for the purpose of applying a pressure to recover the ink viscosity and the purpose of discarding the thickened ink. Conventionally, the purge operation is always performed by a predetermined pressure applied for a predetermined period in a single uniform way, and the predetermined pressure and the predetermined period are determined in advance on the basis of experiments. However, even if the same pressure is applied for the same period, the amount of ink discharged from the nozzle plate 114 varies depending upon the ink viscosity, i.e., the viscosity level. As a result, when the ink is not so thickened, ink may be excessively discarded by the purge operation. Conversely, when the ink is highly thickened beyond estimation, the thickened ink may not sufficiently be discarded even after the purge operation so that the thickened ink is lingering in the ink jet head 113 resulting in insufficient recovery.

In contrast to this, in accordance with the present embodiment, the applied pressure is determined depending upon the variation degree of the flow resistance. While the applied pressure is determined in correspondence with the viscosity level of ink, in place of changing the applied pressure, the period of applying the pressure may be adjusted with reference to the variation degree of the flow resistance. By this configuration, even if the ink is thickened to a different viscosity level, a predetermined amount of the thickened ink can always be discharged, and thereby it is possible to avoid the above shortcomings that ink is excessively discarded in vain, or the thickened ink is not sufficiently discarded to recover the ink quality.

In addition to this, for accelerating the recovery, the ink may be agitated and/or pressurized in the ink jet heads 113, for example, by applying fine vibration to the nozzle plate 114 in order not to eject ink or performing ink ejection operation during the purge operation.

The recovery becomes easier by employing a stronger maintenance operation. However, the ink consumption increases as the applied pressure becomes higher and the period of applying the pressure becomes longer. On the other hand, when the ink is thickened to a high viscosity level, the recovery is difficult even after repeating a mild maintenance operation, and thereby a stronger maintenance operation has eventually to be used for secured recovery. In such a case, the maintenance time becomes longer, and a larger amount of ink is consumed. When maintenance operations are designed in correspondence with the respective viscosity levels, it is preferred to determine, by experiments or the like, what type of maintenance operation is most effective to achieve recovery for each viscosity level.

Also, in the case where the ink jet printer 100 is used in a broader temperature range, even when the ink viscosity changes under the influence of the varying environmental temperature, it is possible to accurately evaluate the viscosity level by providing a temperature sensor such a thermistor or a thermocouple located near the ink jet heads 113 or the distributor 111, and compensating the time measured for use in evaluating the ink viscosity with reference to the ink temperature detected by the temperature sensor. In a simplified method, the ink viscosity can be evaluated by the use of evaluation criteria which have been prepared in advance on the basis of the experiments or the like relating to the relationship between the ink temperature and the time required for a predetermined amount of ink to flow from the upstream tank 220 to the downstream tank 230 at the ink temperature.

When "small viscosity increase" or a larger viscosity increase is evaluated by ink evaluation which is conducted after performing the maintenance operation corresponding to the viscosity level as evaluated, it is likely that the viscosity level has not been recovered, so that the maintenance operation is preferably performed again. Also, in this case, an appropriate maintenance operation is selected on the basis of the viscosity level which is evaluated. However, if the same viscosity level is repeatedly evaluated, a larger amount of ink may eventually be consumed, or a longer maintenance time may be needed. In such a case, thereby, it is preferred to perform the maintenance operation that is next stronger than the previous maintenance operation.

Figure 14A:
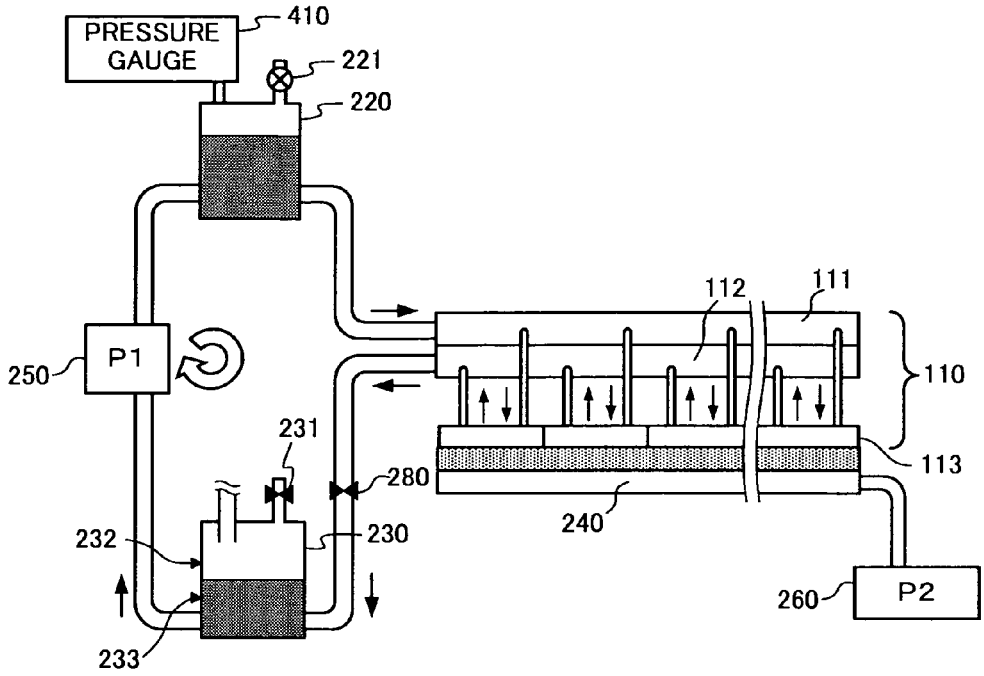
FIG. 14A is a block diagram for showing a first exemplary modification in accordance with the present invention.
Figure 15:
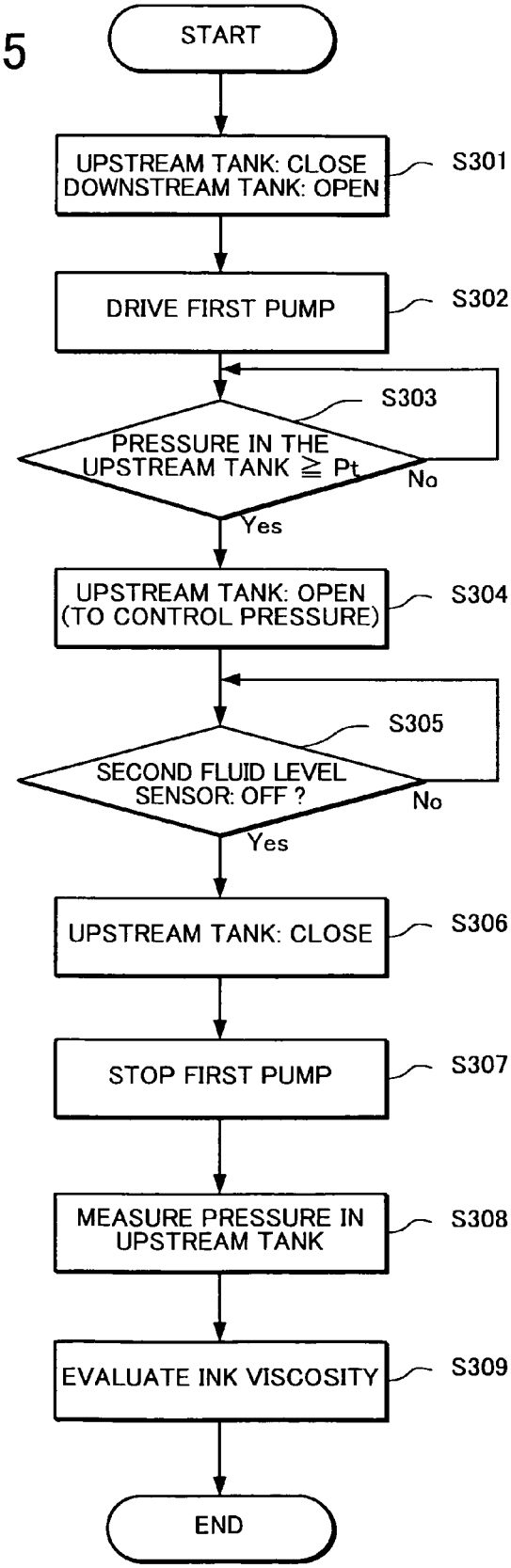
FIG. 15 is a flow chart for showing the first exemplary modification in accordance with the present invention.

Next, several modification examples of the present embodiment will be explained. In this modification, a pressure gauge is provided for measuring a value which is indicative of the flow resistance for use in evaluating the ink viscosity. First, a first modification example will be explained with reference is a block diagram of FIG. 14A and a flow chart of FIG. 15. The pressure gauge 410 of the first modification example is provided for the upstream tank 220.

When the value indicative of the flow resistance is measured by the use of fluid level sensors, the ink surface level of the upstream tank 220 and the ink surface level of the downstream tank 230 are preferably adjusted to predetermined levels respectively in order to set up the differential pressure between the upstream tank 220 and the downstream tank 230 to a constant value, in advance of measuring the value indicative of the flow resistance. However, in the case of the first modification example, while the first pump 250 is driven to lower the ink surface level of the downstream tank 230 to a predetermined level, the air release valve 221 of the upstream tank 220 is controlled in order to adjust the pressure inside the upstream tank 220, which is measured by the pressure gauge 410, to a predetermined pressure.

More specifically speaking, first, the first pump 250 is driven in step S302 after closing the air release valve 221 of the upstream tank 220 and opening the air release valve 231 of the downstream tank 230 in step S301. Thereafter, when the pressure of the upstream tank 220 becomes greater than or equal to a predetermined value Pt (step S303: Yes), the air release valve 221 of the upstream tank 220 is opened in order not to exceed the predetermined pressure in step S304.

The second fluid level sensor 233 of the downstream tank 230 is turned off (step S305: Yes), the operation of the first pump 250 is halted in step S307 with the air release valve 221 of the upstream tank 220 being closed in step S306. The differential pressure between the upstream tank 220 and the downstream tank 230 is the predetermined value Pt when halting the operation of the first pump 250, and then ink flows from the upstream tank 220 into the downstream tank 230 through the ink jet heads 113 such that the pressure inside the upstream tank 220 drops. The value indicative of the flow resistance can be obtained in step S308 as the pressure of the upstream tank 220 which is measured by the pressure gauge 410 after a predetermined time elapsed, or the time elapsed until the pressure inside the upstream tank 220 drops to a predetermined pressure. The ink viscosity is evaluated on the basis of the value indicative of the flow resistance as measured in step S309.

Figure 14B:
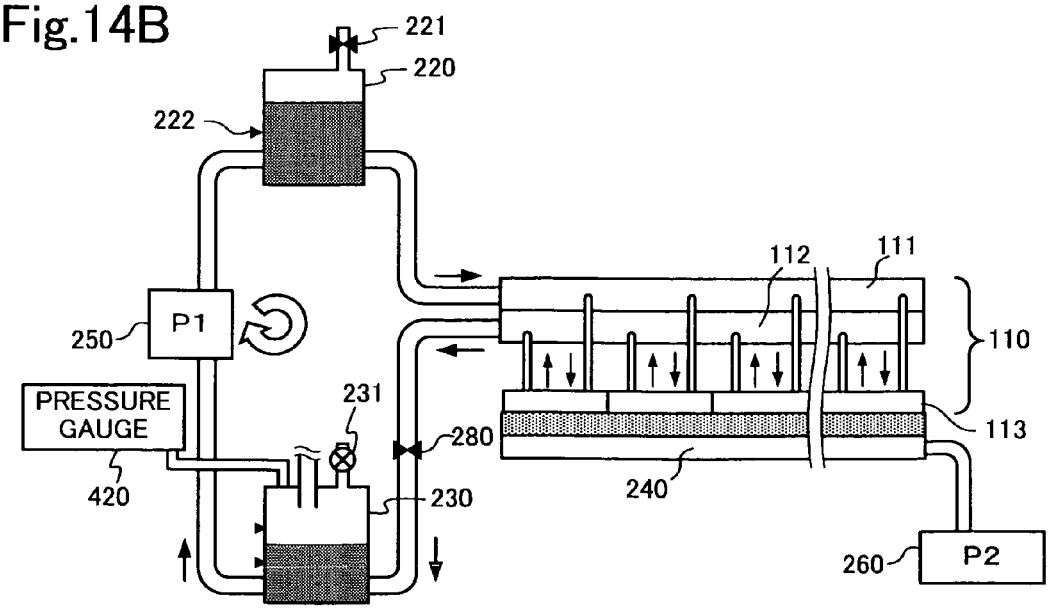
FIG. 14B is a block diagram for showing a second exemplary modification in accordance with the present invention.

FIG. 14B is a block diagram for showing a second modification example provided with a pressure gauge 420 for measuring the pressure inside the downstream tank 230. Furthermore, in the case of the second modification example, the upstream tank 220 is provided with a third fluid level sensor 222. In this example, the first pump 250 is driven until the third fluid level sensor 222 is turned on, and at the same time the pressure of the downstream tank 230 is adjusted to a predetermined level. Thereafter, in the same manner as in the first modification example, the value indicative of the flow resistance can be obtained as the pressure of the downstream tank 230 which is measured by the pressure gauge 420 after a predetermined time elapsed, or the time elapsed until the pressure inside the downstream tank 230 rises to a predetermined pressure.

Figure 16:
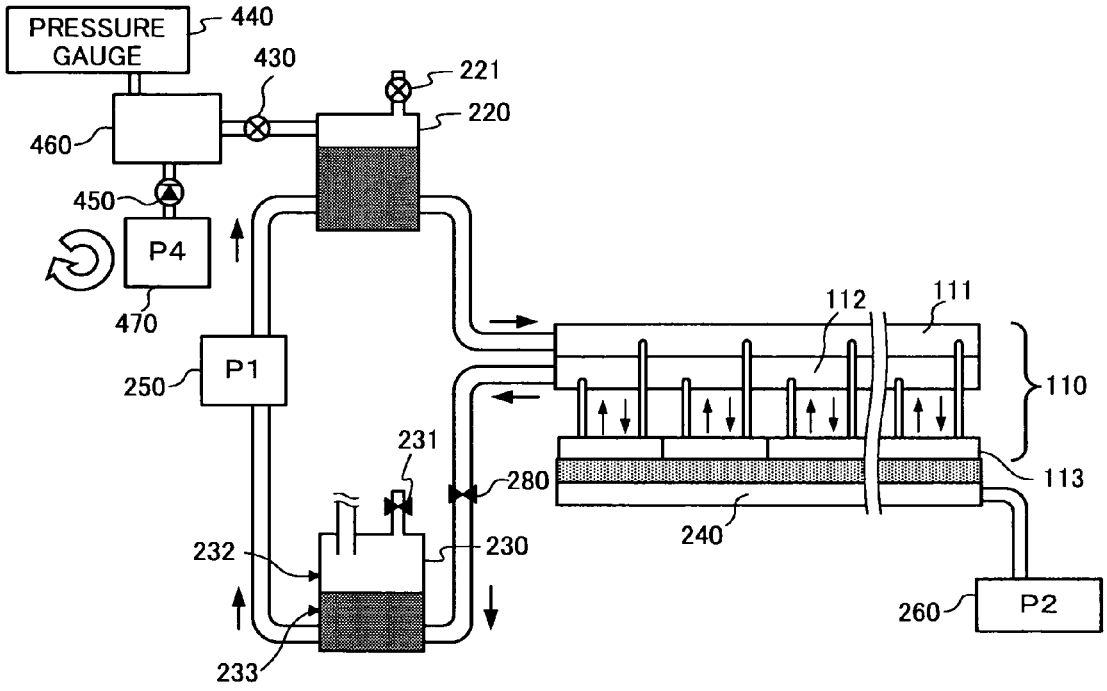
FIG. 16 is a block diagram for showing a third exemplary modification in accordance with the present invention.

FIG. 16 is a block diagram for showing a third modification example provided with a fourth pump for applying a pressure in addition to the first pump for ink circulation. As shown in the same figure, in the case of the third modification example, a pneumatic chamber 460 is connected to the upstream tank 220 through a non-off valve 430. The pneumatic chamber 460 is further connected to a pressure gauge 440 and connected to the fourth pump 470 through a one-way valve 450.

Figure 17:
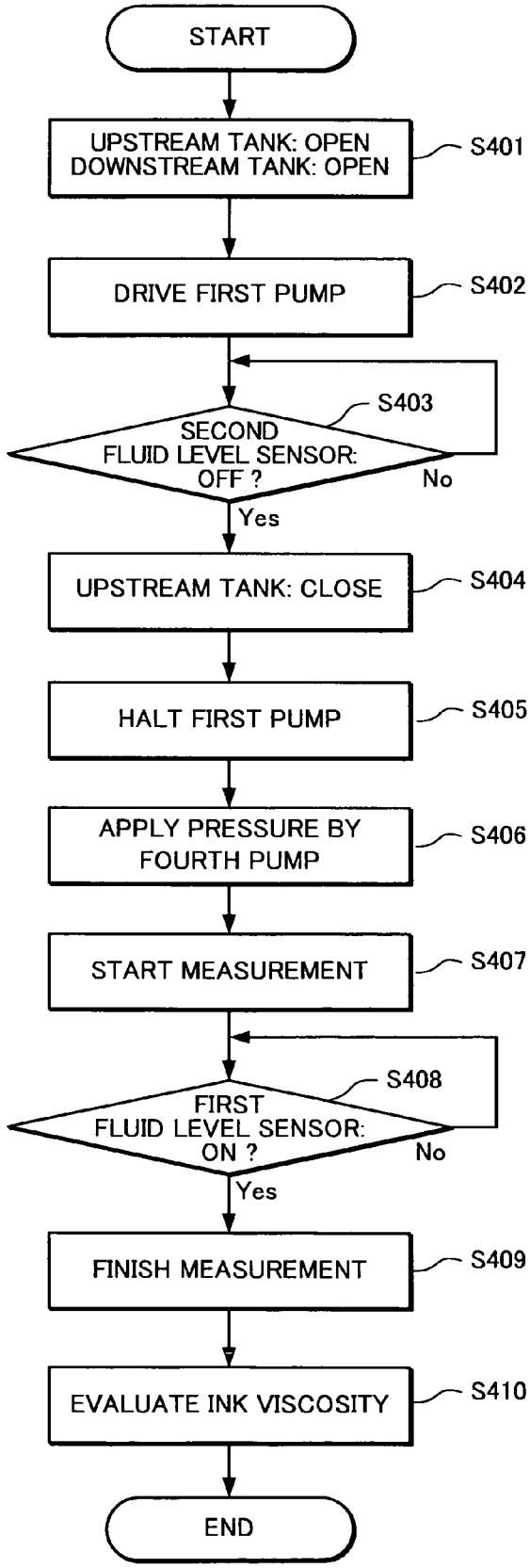
FIG. 17 is a flow chart for showing the third exemplary modification in accordance with the present invention.

FIG. 17 is a flow chart for explaining the process of measuring the value indicative of the flow resistance in accordance with the third exemplary modification. In this measuring process, first, the first pump 250 is driven in step S402 after opening the air release valve 221 of the upstream tank 220 and the air release valve 231 of the downstream tank 230 in step S401. Then, when the second fluid level sensor 233 of the downstream tank 230 is turned off (step S403: Yes), the air release valve 221 of the upstream tank 220 is closed in step S404, and the operation of the first pump is halted in step S405.

Next, a predetermined pressure is applied to the upstream tank 220 in step S406 by opening the on-off valve 430 of the pneumatic chamber 460 which is pressurized to a predetermined pressure by driving the fourth pump 470 in advance. In this state, the measurement of the elapsed time is started in step S407. When the first fluid level sensor 232 of the downstream tank 230 is turned on (step S408: Yes), the measurement of the elapsed time is stopped in step S409. Then, the ink viscosity is evaluated on the basis of the elapsed time as measured in step S410. In the case of the third exemplary modification, by providing the fourth pump 470 for applying a pressure separately from the first pump for ink circulation, it is possible to measure the value indicative of the flow resistance while controlling the pressure in the upstream tank 220 to a predetermined pressure. Incidentally, the fourth pump 470 can be used also as a pressure pump which serves to perform a purge operation for pushing out ink from the nozzle plate 114.

As has been discussed above, in accordance with the present invention, it is possible to reduce the maintenance time and unnecessary ink consumption by evaluating the ink viscosity on the basis of the value indicative of the flow resistance as measured, and performing an appropriate maintenance operation in accordance with the evaluation result.

What is claimed is:

1. An ink jet printer provided with an ink circulation route in which are arranged an ink jet head for ejecting ink, a first tank for supplying ink to the ink jet head, a second tank for collecting ink which is not consumed by the ink jet heads, said ink jet printer comprising:

a maintenance unit operable to perform a maintenance operation which consumes some amount of ink;

a measuring unit operable to obtain a value indicative of the flow resistance measured when ink flows from the first tank to the second tank through the ink jet head; and a control unit operable to select one of maintenance operations on the basis of the value indicative of the flow resistance as obtained, wherein when the value indicative of the flow resistance as obtained is lower than a predetermined value, the control unit selects the operation of circulating ink around the ink circulation route as the one of maintenance operations, and the maintenance unit does not perform the maintenance operation which consumes some amount of ink.

2. The ink jet printer as claimed in claim 1 wherein each of the first tank and the second tank is provided with an air release valve for releasing the inner pressure of each tank to air, the first tank is arranged in an upper position than the ink jet head, and the ink jet head is arranged in an upper position than the second tank.

3. The ink jet printer as claimed in claim 2 wherein the measuring unit obtains the value indicative of the flow resistance by opening the air release valves of the first and second tanks, and measuring the time required for a predetermined amount of ink to flow from the first tank to the second tank.

4. The ink jet printer as claimed in claim 2 wherein the second tank is provided with upper and lower ink surface level sensors, wherein the measuring unit obtains the value indicative of the flow resistance by opening the air release valves of the first and second tanks, and measuring the time elapses until the upper ink surface level sensor detects the ink surface level after the lower ink surface level sensor detects the ink surface level.

5. The ink jet printer as claimed in claim 3 further comprising:

a pressure adjusting unit operable to adjust the pressure of the first tank to a predetermined value in advance of measuring the required time, wherein the measuring unit measures the required time while the pressure of the first tank adjusted by the pressure adjusting unit is maintained to the predetermined value.

6. The ink jet printer as claimed in claim 1 further comprising:

a first pump operable to transport ink from the second tank to the first tank, wherein the first pump is driven when circulating ink around the ink circulation route as the maintenance operation.

7. The ink jet printer as claimed in claim 6, wherein the maintenance operation which consumes some amount of ink performed by the maintenance unit includes the operation of suctioning ink from an ink ejection surface of the ink jet head after circulating ink by driving the first pump.

8. The ink jet printer as claimed in claim 7, wherein the maintenance unit changes, with reference to the value indicative of the flow resistance as obtained, the time for which ink is suctioned from the ink ejection surface of the ink jet head, or the force of suctioning ink.

9. The ink jet printer as claimed in claim 1, wherein the control unit determines the viscosity level of ink on the basis of the value indicative of the flow resistance, and selects the maintenance operation with reference to the viscosity level as determined.

10. The ink jet printer as claimed in claim 1, wherein the measuring unit obtains the value indicative of the flow resistance again after performing the maintenance operation which consumes some amount of ink or the maintenance operation of circulating ink around the ink circulation route, wherein the control unit determines whether to perform the maintenance again on the basis of the value indicative of the flow resistance which is obtained again.

11. The ink jet printer as claimed in claim 1, further comprising a maintenance system designed to cover the ink jet head and serves also as a cap for covering the ink ejection surface of the ink jet head.

* * * * *